US010358280B2

(12) United States Patent
Falcon et al.

(10) Patent No.: US 10,358,280 B2
(45) Date of Patent: Jul. 23, 2019

(54) AEROSOL ACTUATORS, DEVICES AND METHODS OF MAKING AND USING THE SAME

(71) Applicant: Silgan Dispensing Systems Corporation, Grandview, MO (US)

(72) Inventors: Sara Jane Falcon, Richmond, VA (US); Ryan A. Bailey, Richmond, VA (US); Kelly A. Harrigan, Richmond, VA (US); Connie Tran, Glen Allen, VA (US); Steve Kazanjian, Los Angeles, CA (US); Bradford J. Walling, Chesterfield, VA (US)

(73) Assignee: Silgan Dispensing Systems Corporation, Grandview, MO (US)

( * ) Notice: Subject to any disclaimer, the term of this patent is extended or adjusted under 35 U.S.C. 154(b) by 31 days.

(21) Appl. No.: 15/861,817

(22) Filed: Jan. 4, 2018

(65) Prior Publication Data

US 2018/0127194 A1 May 10, 2018

Related U.S. Application Data

(63) Continuation of application No. 14/416,301, filed as application No. PCT/US2013/051618 on Jul. 23, 2013, now Pat. No. 9,889,982.

(60) Provisional application No. 61/674,625, filed on Jul. 23, 2012.

(51) Int. Cl.

| | |
|---|---|
| ***B65D 83/20*** | (2006.01) |
| ***B65D 83/22*** | (2006.01) |
| ***B65D 83/30*** | (2006.01) |
| ***B65D 83/38*** | (2006.01) |
| ***B05B 15/14*** | (2018.01) |
| *B05B 11/00* | (2006.01) |
| *B65D 83/16* | (2006.01) |
| *B05B 12/00* | (2018.01) |

(52) U.S. Cl.

CPC ..... *B65D 83/201* (2013.01); *B05B 15/14* (2018.02); *B65D 83/205* (2013.01); *B65D 83/206* (2013.01); *B65D 83/22* (2013.01); *B65D 83/30* (2013.01); *B65D 83/386* (2013.01); *B05B 11/0027* (2013.01); *B05B 11/0059* (2013.01); *B05B 12/002* (2013.01); *B65D 83/16* (2013.01)

(58) Field of Classification Search

CPC ..... B65D 83/201; B65D 83/205–206; B65D 83/22; B65D 83/30; B65D 83/386; B65D 83/16; B05B 15/14; B05B 83/16; B05B 12/002; B05B 11/0027; B05B 11/0059

USPC ..... 222/153.13, 402.12–402.13, 402.15, 222/402.21

See application file for complete search history.

(56) References Cited

U.S. PATENT DOCUMENTS

| | | | | |
|---|---|---|---|---|
| 3,149,757 A | | 9/1964 | Safianoff | |
| 3,170,606 A | | 2/1965 | Boyer | |
| 3,648,905 A | * | 3/1972 | Kauder | B65D 83/20 222/153.11 |
| 3,837,537 A | | 9/1974 | Baldwin | |

(Continued)

*Primary Examiner* — Paul R Durand
*Assistant Examiner* — Andrew P Bainbridge
(74) *Attorney, Agent, or Firm* — Barlow Josephs and Holmes LTD; Stephen Holmes

(57) ABSTRACT

Aerosol actuation mechanisms include improvements allowing a user to extend the reach of an aerosol application device, apply an aerosol in a windy environment, improve coverage of the aerosol product, or facilitate improved ability to ensure coverage for an aerosol product.

13 Claims, 16 Drawing Sheets

(56) References Cited

U.S. PATENT DOCUMENTS 4,324,351 A 4/1982 Meshberg
4,579,258 A 4/1986 Brown et al.
4,759,309 A * 7/1988 Zediker ..... B65D 83/75 116/112
4,880,143 A 11/1989 Murray et al.
D333,778 S * 3/1993 Magidson ..... 222/402.15
D349,642 S * 8/1994 Abfier ..... D9/685
5,918,774 A 7/1999 Lund et al.
5,918,780 A 7/1999 Tanaka
6,340,103 B1 * 1/2002 Scheindel ..... B65D 83/201 222/402.15
6,474,510 B2 11/2002 Frutin
6,966,461 B2 * 11/2005 Warner ..... B65D 83/203 222/174
7,004,359 B2 * 2/2006 Marroncles ..... B65D 83/206 222/402.12
7,124,916 B2 10/2006 Groh et al.
7,631,785 B2 * 12/2009 Paas ..... B65D 83/384 222/182
7,686,193 B1 3/2010 Gervais et al.
7,757,906 B2 * 7/2010 Barry ..... B65D 83/206 116/214
7,891,529 B2 2/2011 Paas et al.
7,959,040 B2 * 6/2011 Heirman ..... B65D 83/206 222/383.1
2004/0256418 A1 * 12/2004 Scheindel ..... B65D 83/202 222/402.15
2005/0269363 A1 12/2005 Restive
2006/0071036 A1 * 4/2006 Gervais ..... B65D 83/202 222/402.15
2008/0017673 A1 * 1/2008 Copps ..... B65D 83/201 222/402.15
2009/0224081 A1 * 9/2009 Rossiter ..... B65D 83/30 239/589
2010/0084434 A1 * 4/2010 Rhoades ..... B65D 83/386 222/162
2010/0224345 A1 * 9/2010 Lyda ..... B65D 83/205 165/104.19
2010/0320237 A1 * 12/2010 Raj ..... B05B 11/306 222/384
2011/0079617 A1 * 4/2011 Quarles ..... B65D 83/201 222/402.15
2011/0233235 A1 * 9/2011 Adams ..... B65D 83/205 222/402.13
2013/0292418 A1 * 11/2013 Zizoune ..... B05B 15/60 222/183
2015/0203279 A1 7/2015 Falcon et al.

* cited by examiner

AEROSOL ACTUATORS, DEVICES AND METHODS OF MAKING AND USING THE SAME

CROSS-REFERENCE TO RELATED APPLICATIONS

This application is a continuation of U.S. application Ser. No. 14/416,301, filed Jan. 22, 2015 and entitled "AEROSOL ACTUATORS, DEVICES, AND METHODS OF MAKING AND USING THE SAME". This application also claims the benefit of, and priority to, U.S. Provisional Application No. 61/674,625, entitled "AEROSOL ACTUATORS, DEVICES, AND METHODS OF MAKING AND USING THE SAME" filed 23 Jul. 2012, and incorporates the same herein by reference in its entirety.

BACKGROUND OF THE INVENTION

1. Field of the Invention

Embodiments of the invention relate to aerosol delivery devices and more particularly to aerosol delivery devices having improved ergonomics, spray angles, actuation systems, spray patterns, and disbursement coverage options.

2. State of the Art

Aerosol dispensing systems are well known and have been used for a variety of applications including paint, air care, hard surface cleaning, personal care products, healthcare products, home and garden products, and other applications. Typically, an aerosol disbursement system includes an aerosol can containing a product and having a valve to retain the product within the aerosol can or container. An actuating device, such as a button or a trigger may open the valve and direct the product in a disbursement pattern.

In some applications of aerosol disbursement, coverage area may be critical or may be an important consideration when selecting a disbursement device. For example, in the application of aerosol sunscreen or suncare products, the coverage area is important and full coverage of the target is desired.

In other applications, ease of use is desired. Again, for example, in suncare and sunscreen applications, ease of application to the entire body is desirable. However, existing products are not always easy to use, especially if one is trying to apply sunscreen to one's back, face, or other hard to reach area.

Therefore, improvements to existing aerosol disbursement systems and actuators and new aerosol actuators and disbursing systems are desirable.

BRIEF SUMMARY OF THE INVENTION

According to certain embodiments of the invention, an aerosol actuator may include a "toggle" feature allowing an aerosol product to be actuated by pressing the toggle actuator from any direction.

According to other embodiments of the invention, an aerosol actuator may include an extended trigger extending along a portion of the aerosol package. The extended trigger may assist a user in actuating the aerosol device. In addition, an extended trigger may be incorporated with a top-button actuation system such that the extended trigger or the button may be used to actuate the aerosol device. The extended trigger may extend down a front portion, side portion, or rear portion of an aerosol device.

According to some embodiments of the invention, an aerosol actuator may be actuated by a squeezable aerosol actuator. In other embodiments, a pull tab may be used to actuate an aerosol actuator. In still other embodiments, an aerosol actuator may include an extendable handle. In other embodiments, an aerosol actuator may include a timer. In still other embodiments, an aerosol actuator may include an integrated hood or wind shield. An aerosol actuator may also include selectable spray patterns. An aerosol actuator may also include a locking mechanism.

In still other embodiments of the invention, an aerosol actuator may include both a spray feature and an applicator for applying a product in either spray form or as a liquid form.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

Figure 1:
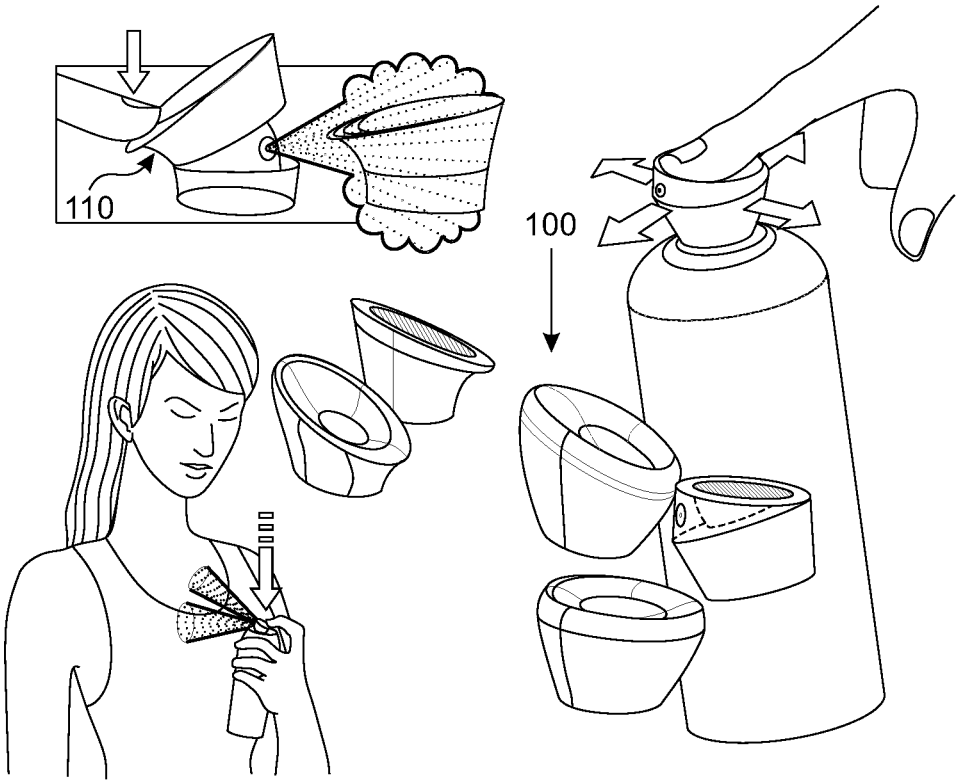
FIG. 1 illustrates various configurations of an aerosol actuator according to various embodiments of the invention.

Various views of an aerosol actuator according to some embodiments of the invention are illustrated in FIG. 1. According to such embodiments, an aerosol actuator may include a toggle feature which may improve the user experience or the ability to disburse a product from an aerosol can using the aerosol actuator.

According to some embodiments of the invention illustrated in FIG. 1, a user may spray an aerosol product by pushing the aerosol actuator 100 in any direction, rather than vertically downward or tilted forward. This may aid in reach or application ease and skin coverage. This may also be particularly useful with aerosols such as sunscreen sprays as they are sprayed towards the body instead of away from the body. Spraying towards the body using a top triggered aerosol often contorts the wrist into awkward positions limiting the downward force that can be applied with the forefinger whereas the aerosol actuators illustrated in FIG. 1 may allow the user to adjust positions without limiting the ability to actuate the aerosol actuator.

A "toggle" motion associated with the aerosol actuator 100 may allow the user to trigger the aerosol more easily. Allowing the user to actuate the spray by rocking their finger in any direction (such as parallel to the body of the primary) makes the actuation more consumer friendly, as often times consumers' forefingers may naturally roll to the side when attempting to spray towards their torso or chest. A toggle motion may also allow the aerosol to spray at a slight angle as it exits the aerosol actuator 100. Embodiments of the invention may also allow the user to rock their finger forwards to spray an aerosol at a downward angle (such as current manifestations of sprays on the market) and to pull backwards to spray an aerosol at an upward angle using the aerosol actuator 100.

In addition, the toggle may also be attached to a larger housing unit which may eliminate the need for a separate overcap. In some embodiments, a toggle valve may use a separate overcap to protect actuation when not in use. However, by integrating a larger housing unit onto the actual toggle, the user may simply pull the unit back and/or down to "toggle" the actuator as illustrated with the aerosol actuator 110.

Figure 2A:
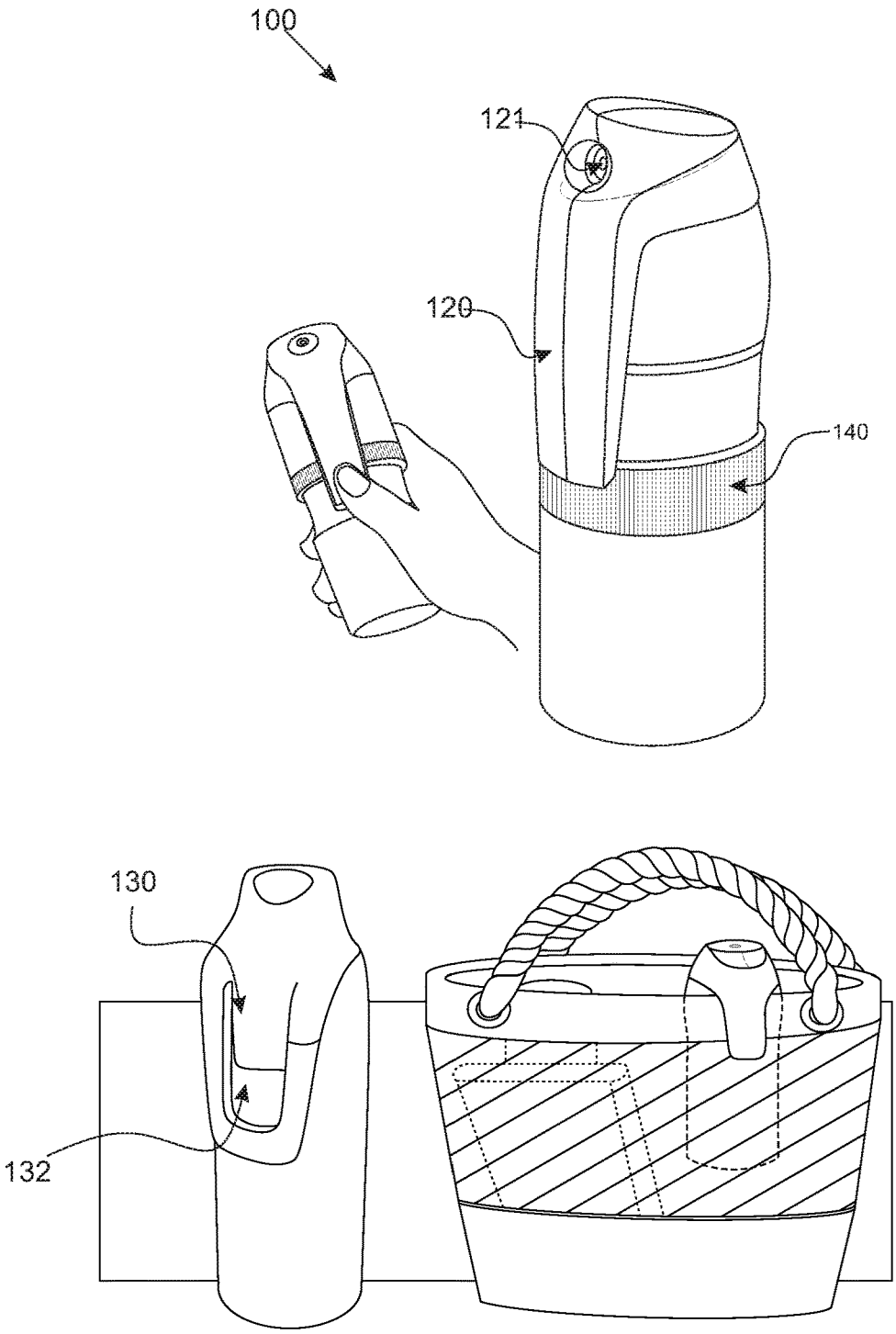
FIG. 2A illustrates an aerosol actuator according to various embodiments of the invention and clip associated with an aerosol actuator according to various embodiments of the invention.
Figure 2B:
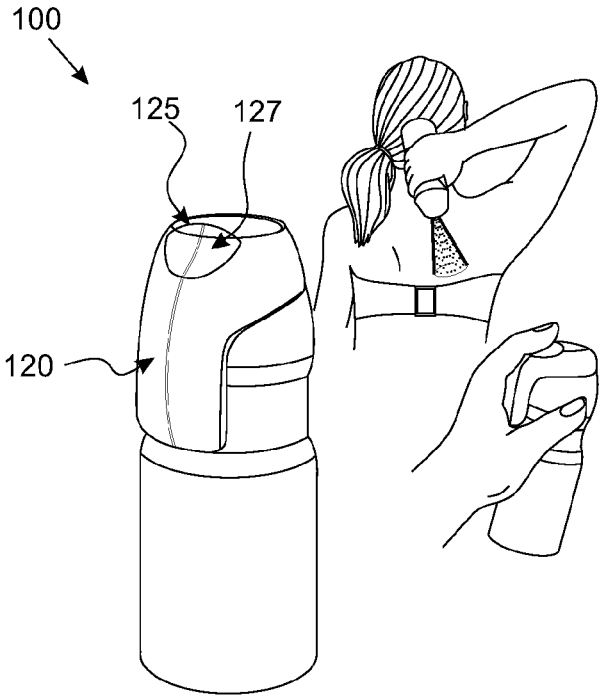
FIG. 2B illustrates an aerosol actuator according to various embodiments of the invention.
Figure 2C:
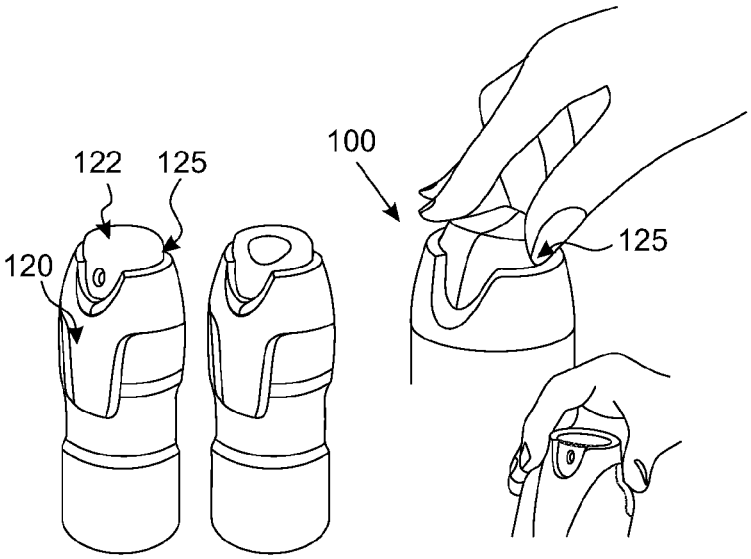
FIG. 2C illustrates an aerosol actuator according to various embodiments of the invention.

Trigger actuated aerosol systems according to various embodiments of the invention are illustrated in FIGS. 2A through 2C. As illustrated in FIG. 2A, an aerosol actuator 100 may include a trigger 120 extending along a portion of the aerosol package. The trigger 120 may be pressed or pulled to actuate the aerosol device. In some embodiments, a trigger 120 may also include one or more integrated spaces or openings 132 which may create a tab or clip 130 which may allow the aerosol device to be clipped to, attached, or otherwise secured on a bag, purse, or other device as illustrated in FIG. 2A.

The trigger 120 illustrated in FIG. 2A includes a front trigger design which may allow users to actuate an aerosol product or device to spray sunscreen or other product with the dispense point or orifice on the same side of the packaging as the trigger 120. A front positioned trigger 120 may also aid in spraying the front and back of one's body with a more neutral hand/wrist position compared to existing top actuated aerosol products.

A trigger 120 aerosol actuator 100 according to other embodiments of the invention is illustrated in FIG. 2B. The trigger 120 design includes a trigger 120 on a side opposite an orifice 121 or dispensing opening, allowing a user to actuate an aerosol device, such as an aerosol sunscreen device, with the dispense point on the opposite side of the packaging from the trigger. In some embodiments, the trigger 120 may be broad to accommodate a comfortable power-grip hand hold during use. A trigger 120 may also aid in spraying the front and back of one's body with a more neutral hand/wrist position compared to existing top actuated aerosol devices. In some embodiments, the trigger 120 may also include an opening 125 through which a button 127 may protrude or through which a traditional aerosol actuator may be accessed so that the trigger 120 may be bypassed and the button 127 or actuator pressed or actuated through the trigger 120 as illustrated in FIG. 2B.

A trigger 120 according to still other embodiments of the invention is illustrated in FIG. 2C. As illustrated, the trigger 120 may be coupled with a top actuator 122 allowing actuation by either the trigger 120 or the top actuator 122. In addition, the top actuator 122 may be configured to rotate and may adjust the direction of the spray of the aerosol device such that it can be turned in a desired direction. As illustrated in FIG. 2C, the top actuator 122 may be rotated to different dispensing positions. Actuation of either the top actuator 122 or the trigger 120 may actuate the aerosol actuator 100 and disperse a product.

The top actuator 122 illustrated in FIG. 2C may also include locking positions in which the top actuator 122 may be turned and locked to ensure dispersing from that location. Audible and tactile responses to the locking and locked positions may be included with various embodiments of the invention.

A trigger 120 such as those illustrated in FIGS. 2A through 2C may be used with an aerosol product to enhance the ergonomics of the aerosol packaging design. This may be particularly useful with aerosols such as sunscreen sprays as they are sprayed towards the body instead of away from the body. Spraying towards the body using a top triggered aerosol often contorts the wrist into awkward positions limiting the downward force that can be applied with the forefinger. Such problems may be eliminated using the aerosol actuators 100 illustrated.

Actuation of the triggers 120 illustrated in FIGS. 2A through 2C may be accomplished in any number of ways, including where the trigger may be squeezed against the aerosol package or container to actuate or may be pulled downward to actuate. For a squeezing motion, when a horizontal force is applied to the trigger by the user, a mechanical action may change the horizontal force into a downward force to apply pressure to actuate the aerosol device. For a pulling motion, the downward force applied to the trigger by the user may directly actuate the aerosol device.

In conjunction with the embodiments illustrated in FIGS. 2A through 2C, a user may also actuate the aerosol actuator 100 in a traditional manner by depressing the top of the aerosol actuator 100 as the trigger 120 and aerosol actuator 100 may be an integrated or assembled part. A section of the aerosol actuator 100 may include a recessed area to create a space for such actuation.

In addition, an aerosol actuator may include various trigger 120 locking features to prevent the package from accidental actuation, such as a locking band or recessed section in the aerosol container. For example, a locking band 140 may be placed in a recessed section of an aerosol container and it may be placed under the trigger so that it cannot be depressed. The locking band 140 may be moved from under the trigger to create a space to actuate the trigger, for instance, using a sliding motion as illustrated in FIG. 2A. Another way to prevent accidental actuation may be by recessing the trigger handle so that it is flush or inset to the container circumference. Recessing the trigger 120 may ensure that objects will come in contact with the outer section before the trigger 120 can be depressed.

Figure 3:
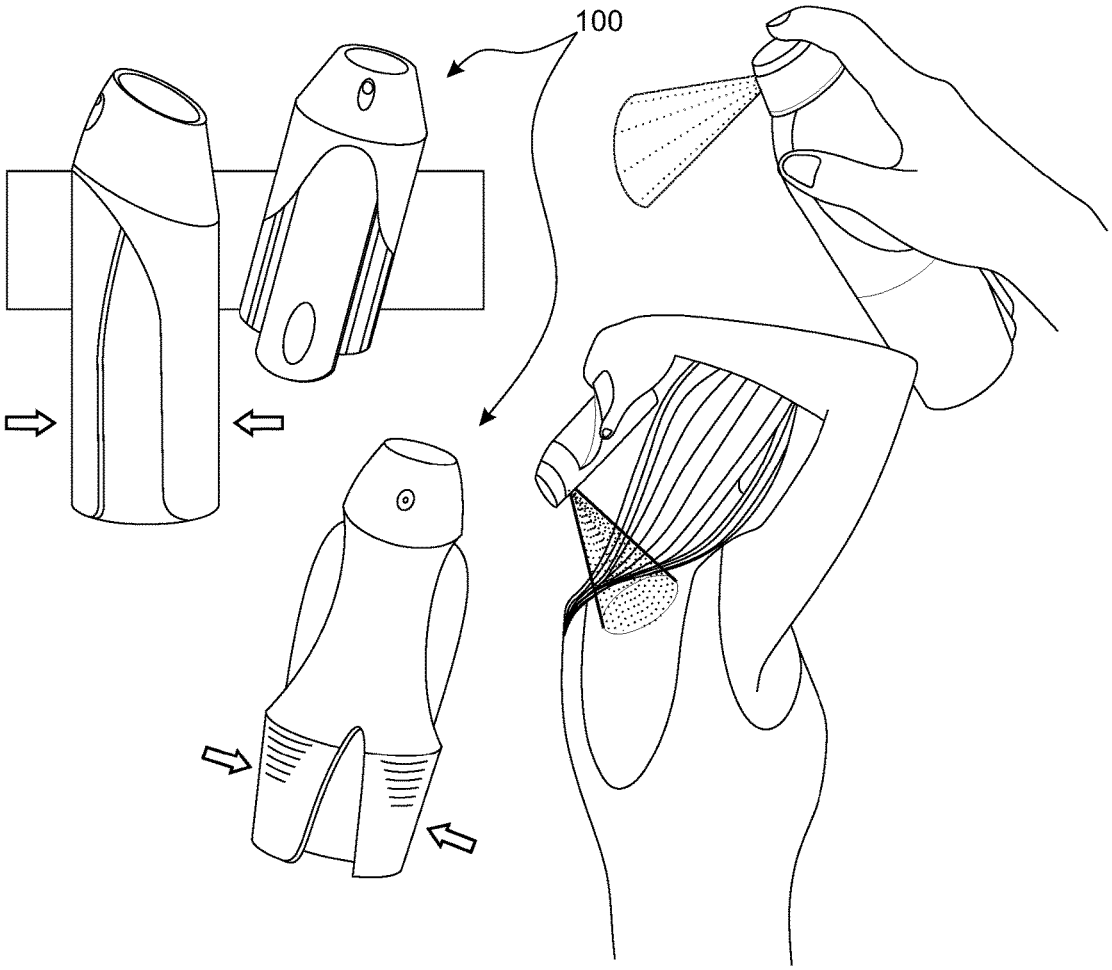
FIG. 3 illustrates a squeezable aerosol actuator according to various embodiments of the invention.

An aerosol actuator 100 according to still other embodiments of the invention is illustrated in FIG. 3. A scissor-like trigger or actuator may be actuated to actuate disbursement of an aerosol product from an aerosol package or device.

According to certain embodiments, the aerosol actuator 100 may include two or more flanges or shapes which may be squeezed together to promote or initiate actuation of an aerosol valve to allow disbursement of an aerosol product. The split trigger or flanges may allow a user to grip the aerosol package in a different location and may increase the user's ability to reach those hard to reach places when applying a product. For example, it may be easier to reach the back of a person for application thereto using the embodiments of the invention illustrated in FIG. 3.

According to embodiments of the invention, the trigger or flanges illustrated in FIG. 3 may be actuated by the user simply squeezing the housing or shroud around the primary aerosol device or packaging. The combined geometry of the shroud/housing—or trigger/flanges—and the packaging cause the aerosol device to be actuated. In some instances, actuation or squeezing of the trigger or flanges creates an upward force which may depress the valve, actuating the spray. In other embodiments, this geometry could include a ramp or a finger in the shroud/housing and it could interact with one or more features in the bottom or the side of the aerosol container.

Figure 4A:
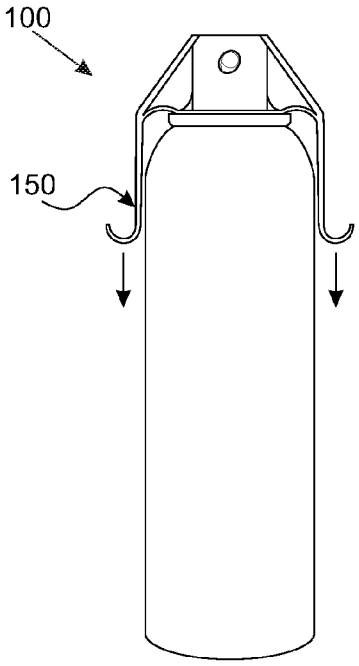
FIG. 4A illustrates aerosol actuator pull tab according to various embodiments of the invention.

Another embodiment of an aerosol actuator 100 is illustrated in FIG. 4A. As illustrated, the aerosol actuator 100 may include a hooked pull tab 150 which may be attached to or molded with an actuation device. One or more hooks on the hooked pull tab 150 may be pulled to actuate the aerosol actuator 100. Actuation in this manner may allow the user to actuate the aerosol device by pulling on the hooks which may extend the reach of the aerosol device, allowing the user to reach areas that cannot be reached if a traditional actuation method is used.

Figure 4B:
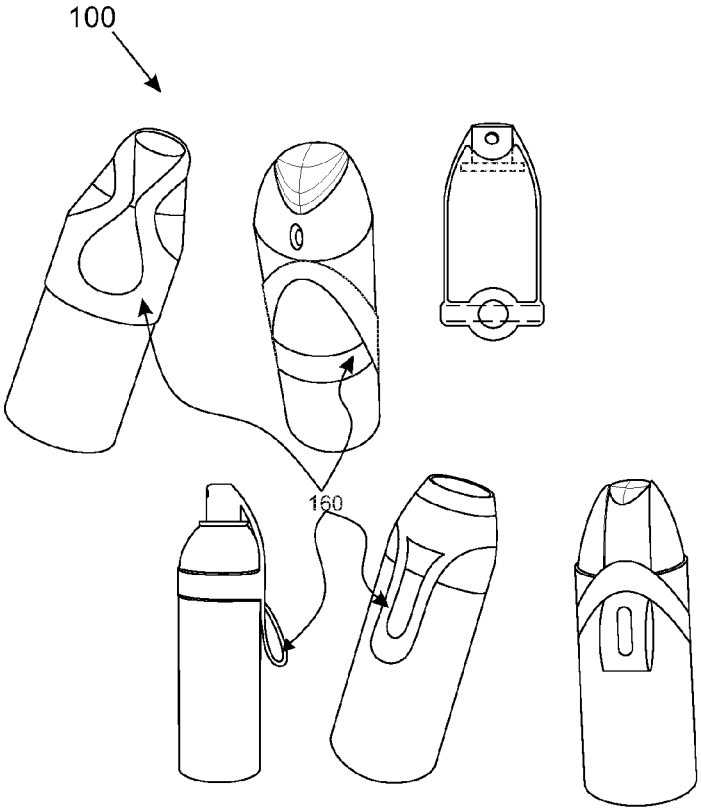
FIG. 4B illustrates an aerosol actuator according to various embodiments of the invention.

Other embodiments of aerosol actuators 100 are illustrated in FIG. 4B. The aerosol actuators 100 may include one or more bands 160 or pull tabs attached to a spray head or integrated therewith. The one or more bands 160 may extend the reach of a user using the device because the spray head may be actuated by the one or more bands 160.

According to embodiments of the invention, a band 160 may be pulled in any direction to facilitate or cause actuation. In some embodiments, a downward direction—or direction away from the spray head—may be a preferred direction. In some embodiments, a band 160 may span a circumference of a container with vertical straps attaching it to the spray head or an actuation head. Pulling on the band 160 may apply a force to actuate the spray head.

Figure 5:
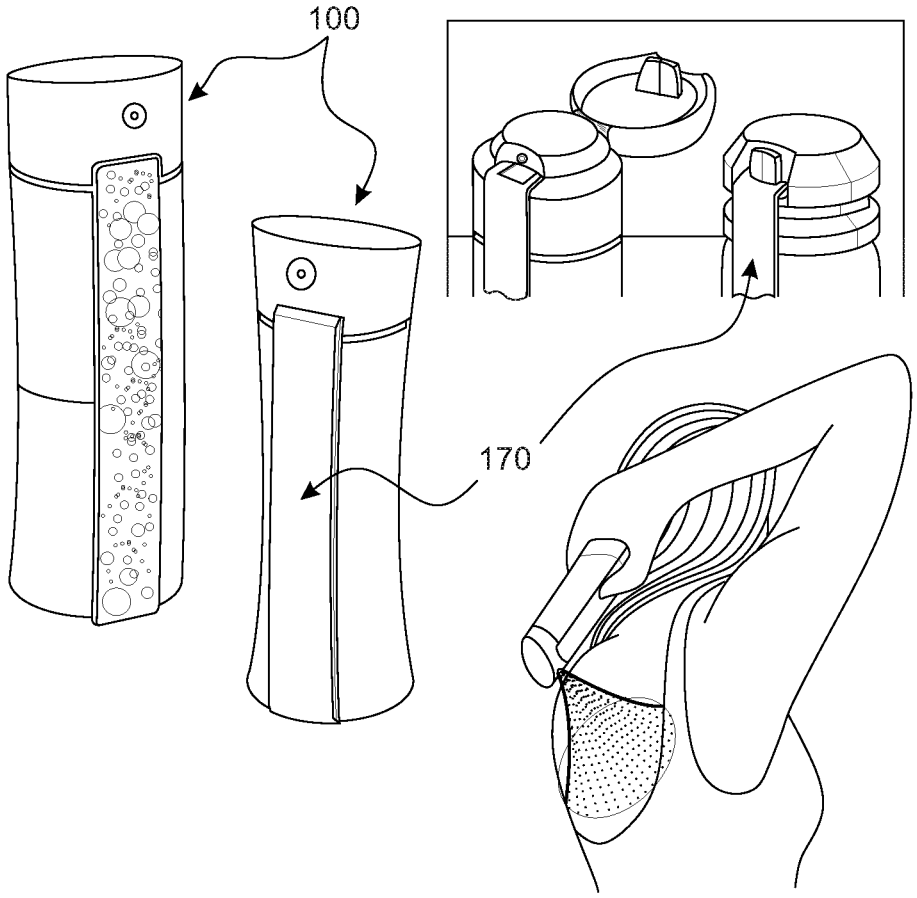
FIG. 5 illustrates an aerosol actuator according to various embodiments of the invention.

According to still other embodiments of the invention, an aerosol actuator 100 may include a push band 170 as illustrated in FIG. 5. When a force is applied to a portion of the push band 170, that force may be translated to an actuation device thereby actuating the aerosol actuator 100.

According to embodiments of the invention, a push band 170 may increase reachability for the user when using the device. Without an added aid whether it be a tool and/or another person, the user may find it difficult to reach certain areas of one's body. Therefore, by strategically re-positioning and manipulating the area of actuation, the user may be better able to access the hard to reach places such as one's upper back.

In some embodiments of the invention, a push band 170 can be executed in a number of ways, but its major advantage is that it allows the user to activate the spray from an infinite number of positions and orientations. In different variations, a push band 170 may travel from the spray actuator down the side of the aerosol device and sometimes around the bottom. An elastic or non-elastic push band 170 may fixed at the end opposite the spray actuator with a void between the push band 170 and aerosol package.

In some embodiments, a lock may be included to lock the device when not in use. One variation of a lock may include a hinged cap. A hinged cap may serve the basic function of covering or exposing the orifice. However, in addition to this basic function, the cap may also have an extruded notch. When the hinged cap is closed, the notch is inserted from above into the slot on the band, thus preventing the band from moving, locking the band in place. In other embodiments, a notch and slot interaction may be used with a rigid ring rather than a hinged cap.

Figure 6:
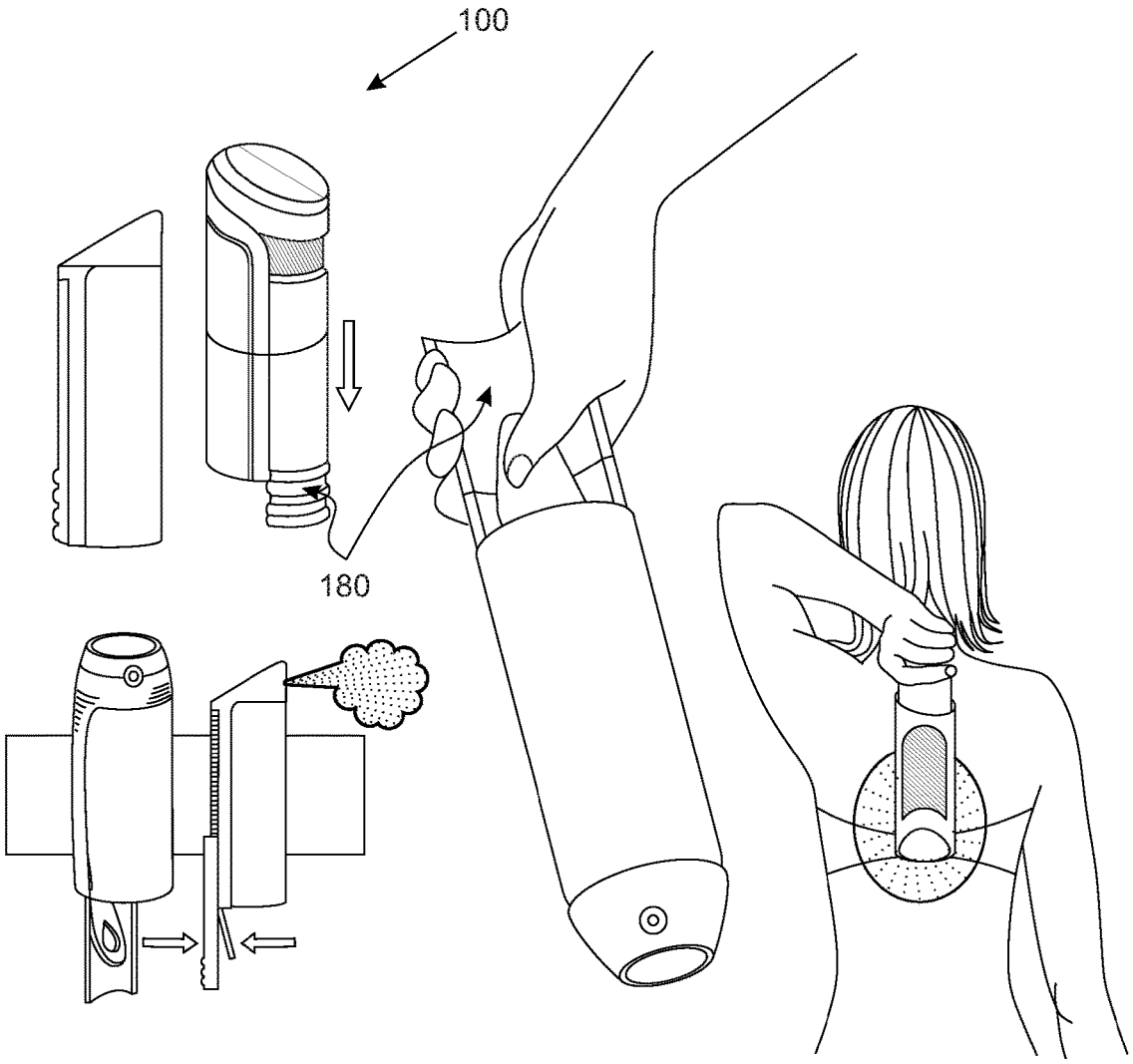
FIG. 6 illustrates an aerosol actuator according to various embodiments of the invention.

An aerosol actuator 100 according to still other embodiments of the invention is illustrated in FIG. 6. As shown, an aerosol actuator 100 may include one or more extendable handles 180 as illustrated. The one or more extendable handles 180 may be locked in a non-extended position and then unlocked and extended in an extended position to facilitate use of the aerosol device. The extendable handles 180 may include one or more actuator buttons which may be depressed or actuated to disperse the aerosol product. Thus, an extended reach for the device is facilitated.

Figure 7A:
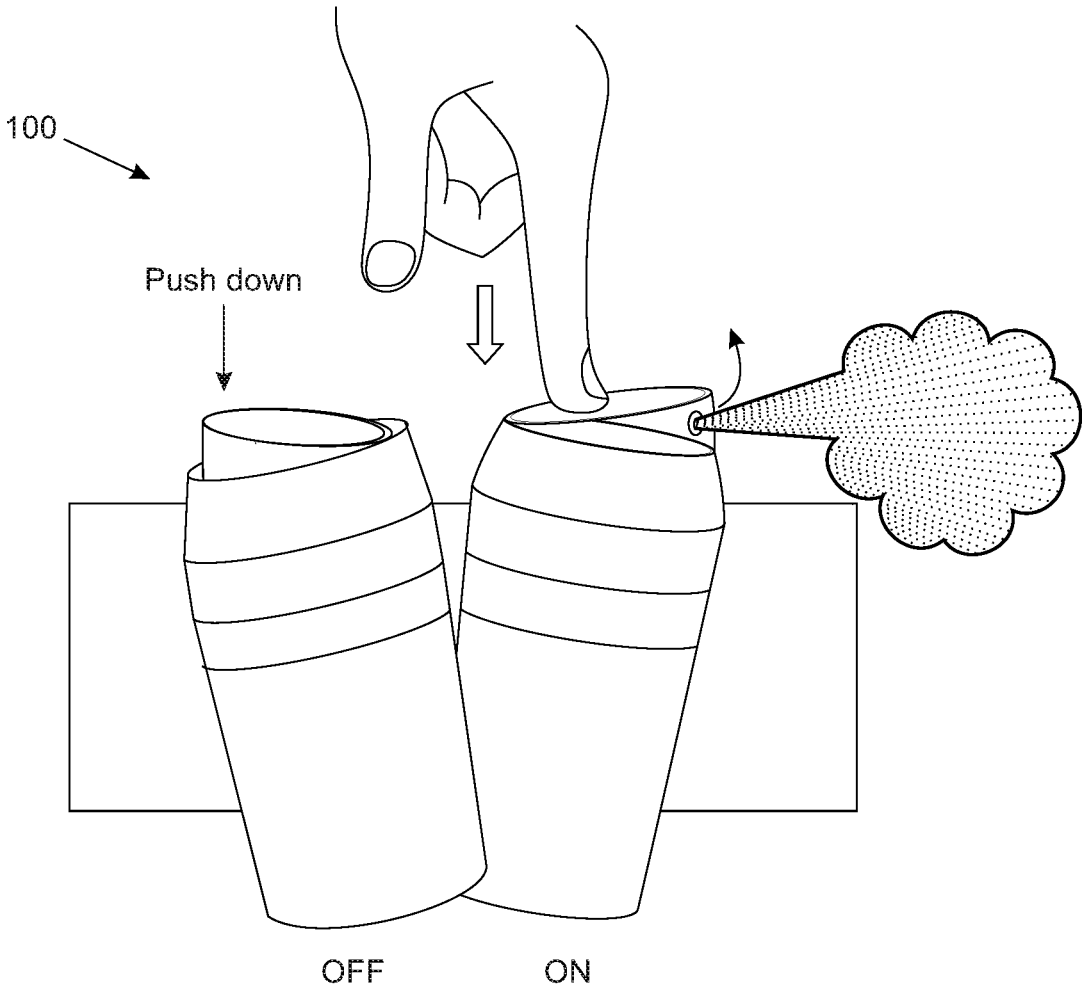
FIG. 7A illustrates an aerosol actuator according to various embodiments of the invention.

According to some embodiments of the invention, an aerosol actuator 100 may be configured to provide a continuous spray when actuated as illustrated in FIG. 7A. Once actuated, the continuous spray may occur until the device is turned off. Thus, a user may grip the device anywhere and apply the spray as desired without needing to continually actuate the device from a fixed position.

Figure 7B:
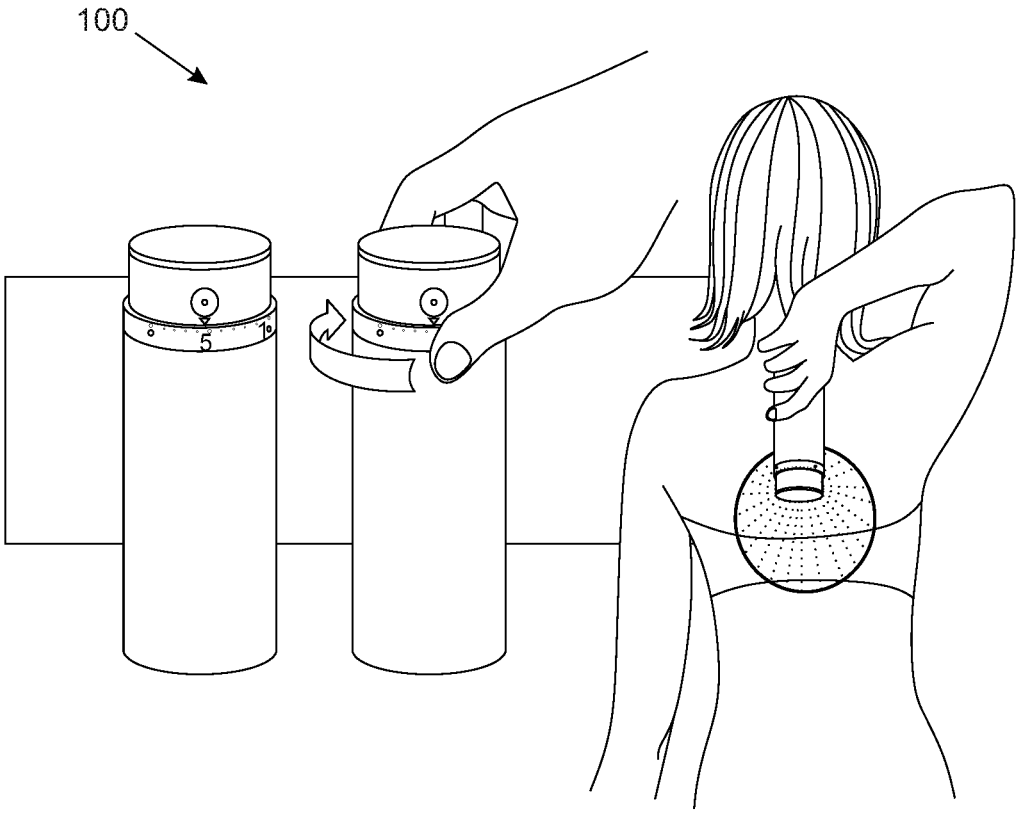
FIG. 7B illustrates an aerosol actuator according to various embodiments of the invention.

FIG. 7B illustrates an additional embodiment wherein a timer is included with the aerosol device. The timer may be set with a disbursement duration and the aerosol actuator 100 actuated. The aerosol actuator 100 may then disburse a product for the allotted time such that a user may grip the device from any location and apply the product as the aerosol actuator 100 automatically sprays the product. According to some embodiments, actuation may be toggled between on and off positions such that manual actuation may also be used.

Figure 8A:
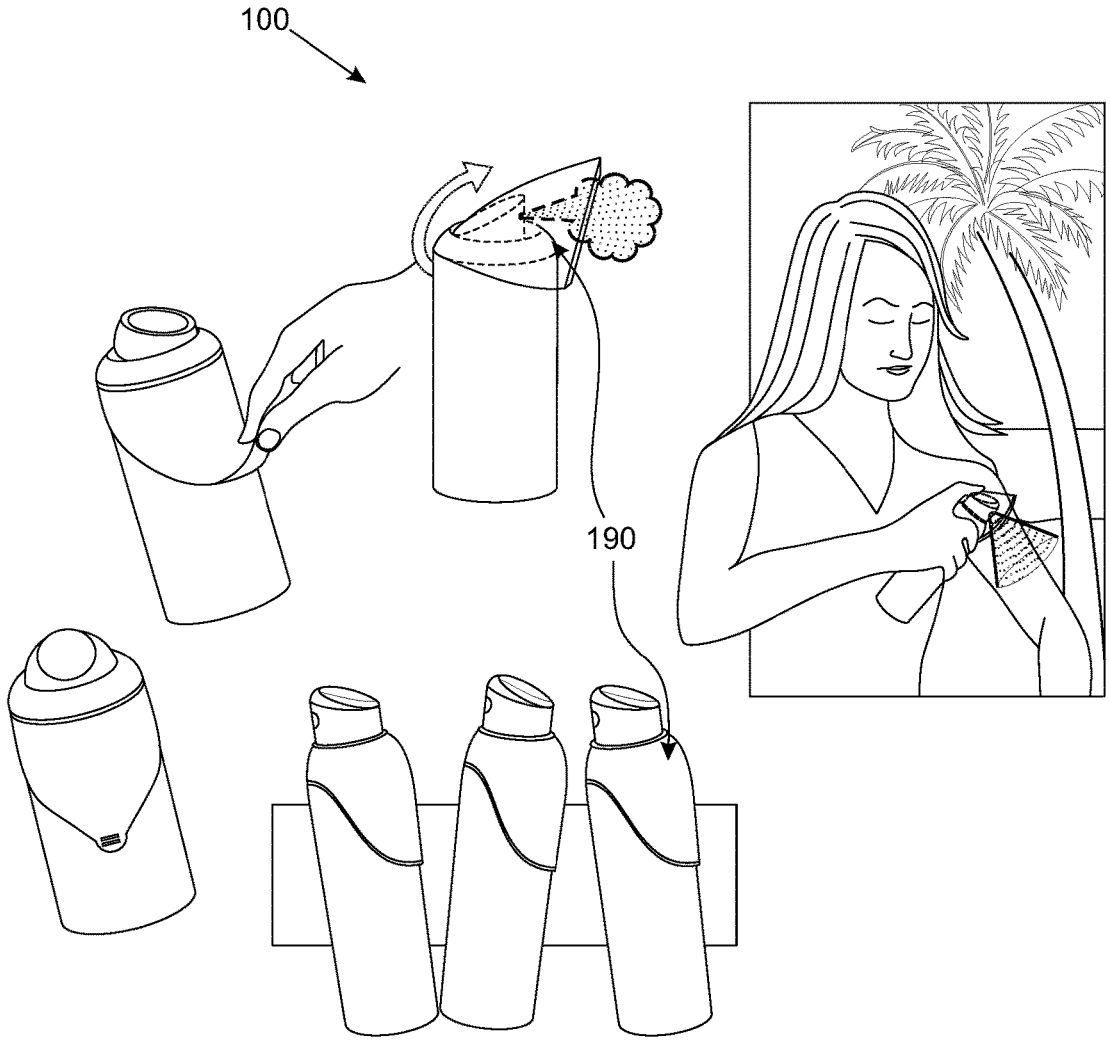
FIG. 8A illustrates an aerosol actuator and hood according to various embodiments of the invention.
Figure 8B:
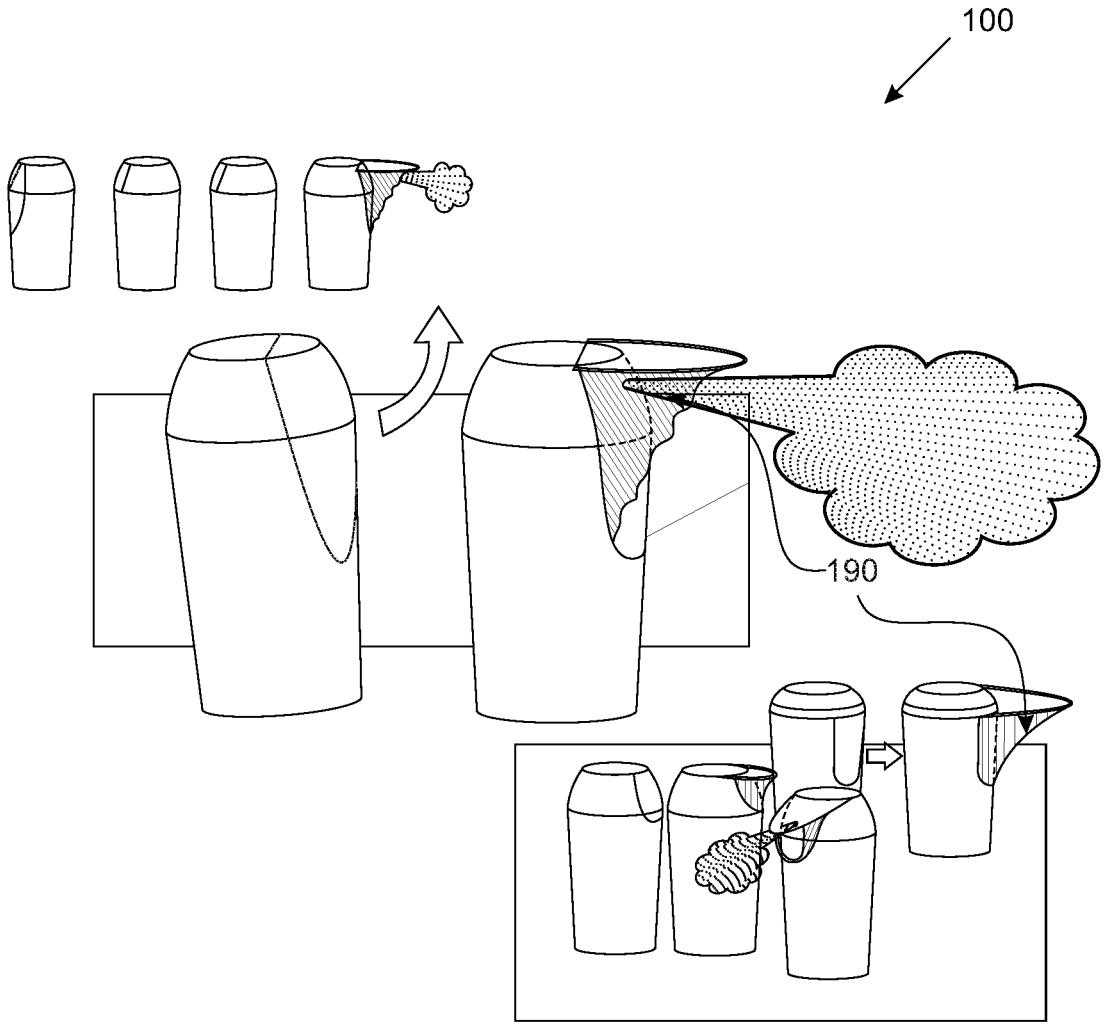
FIG. 8B illustrates an aerosol actuator and hood according to various embodiments of the invention.

According to still other embodiments of the invention, an integrated hood 190 or wind shield may be incorporated with an aerosol device or aerosol actuator 100 as illustrated in FIGS. 8A and 8B. In some embodiments, a hood 190 may be integrated with the aerosol actuator 100. In other embodiments, a hood 190 may be integrated with the aerosol package or container. A hood 190 may be used to protect the dispensing head or orifice through which a product is delivered from an aerosol actuator 100 from the wind. Thus, a product may be better directed and may not disperse as easily when being applied in a windy environment.

According to some embodiments of the invention, a hood 190 may include a silicon or elastomeric pull over hood 190 as illustrated in FIG. 8A. The hood 190 may conform to the container or body of the aerosol device and may be pulled over the top of the device to create a wind shield for the aerosol actuator 100. In addition, when in a non-hood position, the elastomeric material may provide improved griping of the device by a user. The hood 190 may also be decorated or branded as desired.

In another example, the hood 190 illustrated in FIG. 8B is of the flip-up variety. The hood 190 may be a rigid wind shield that conforms to the body of the aerosol device when not in use. In addition, the hood 190 may act as a locking arm, locking the device from actuation in a down position and allowing actuation only when moved into an up position.

Figure 9:
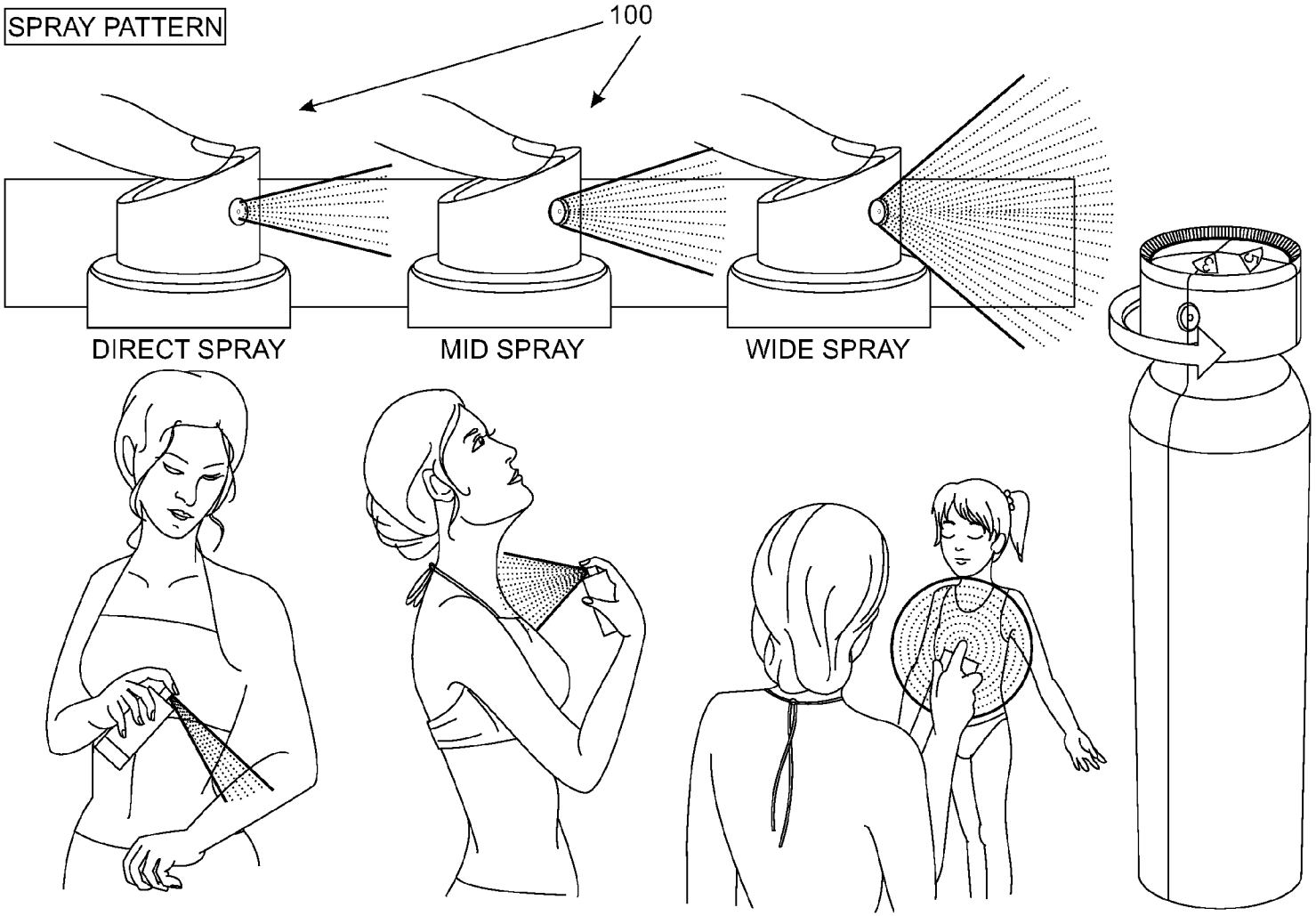
FIG. 9 illustrates an aerosol actuator according to various embodiments of the invention.

According to still other embodiments of the invention, an aerosol actuator 100 may include selectable spray patterns as illustrated in FIG. 9. Using different spray pattern orifice cups or an adjustable orifice, the spray may be tailored to a user's requirements, allowing a small cone, medium cone, or large cone of spray. Other configurations may provide other spray patterns or other spray pattern sizes.

Figure 10A:
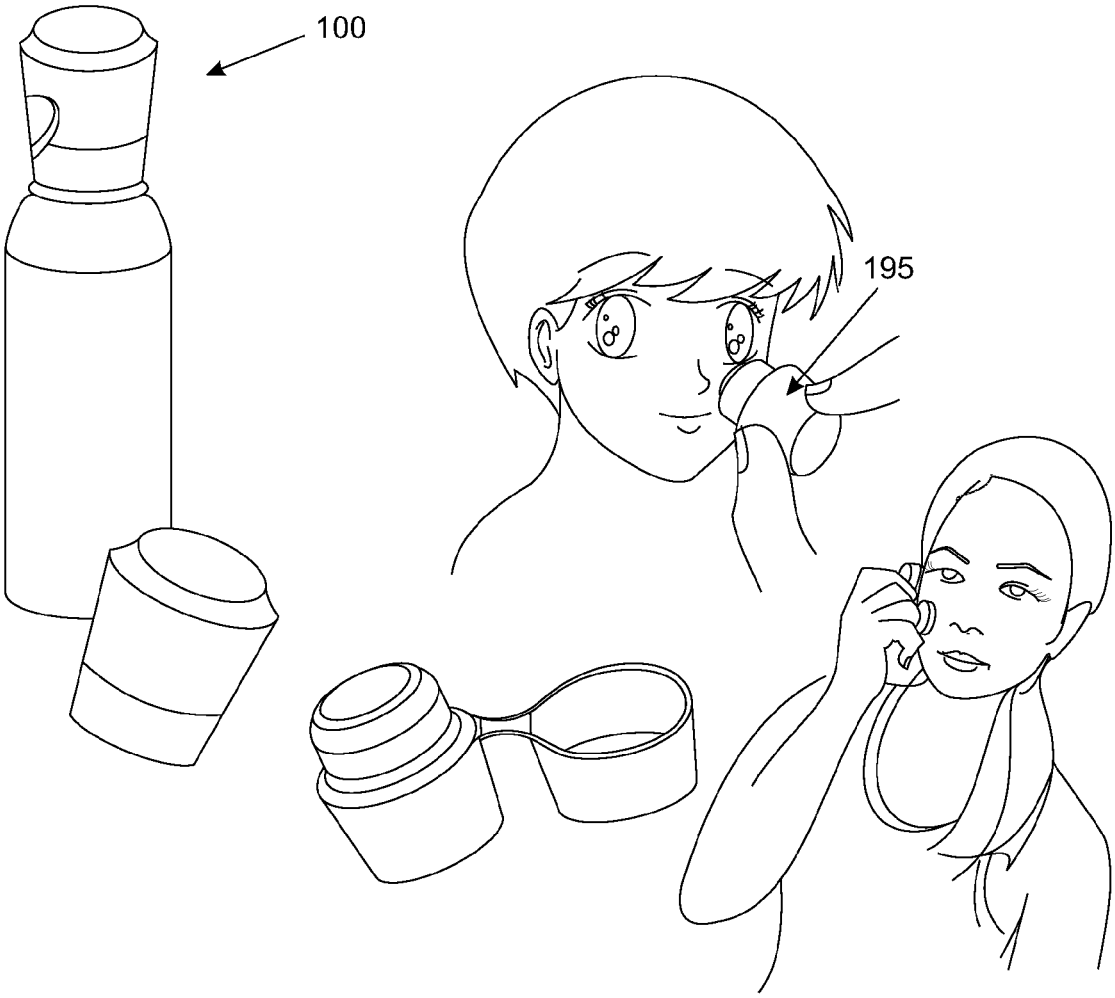
FIG. 10A illustrates an aerosol actuator and product application device according to various embodiments of the invention.
Figure 10B:
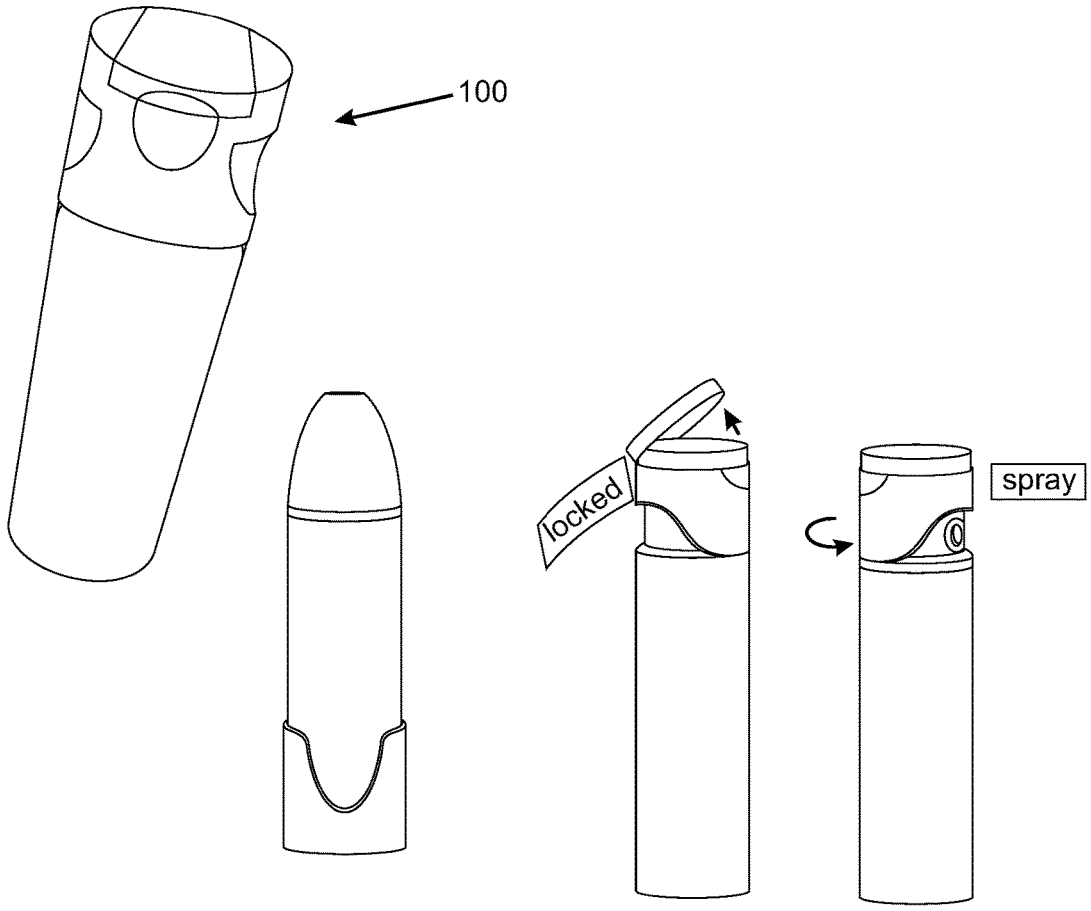
FIG. 10B illustrates an aerosol actuator and product application device according to various embodiments of the invention.

In still other embodiments of the invention, an aerosol actuator 100 may include one or more modular components 195 which may be removed to apply a product to a surface. For example, as illustrated in FIG. 10A, a modular stick may be included in the aerosol package for application of a product to the face or other surface where aerosol application may not be feasible. The modular stick may attach to the top or bottom of a device as illustrated in FIG. 10A or 10B.

Figure 11:
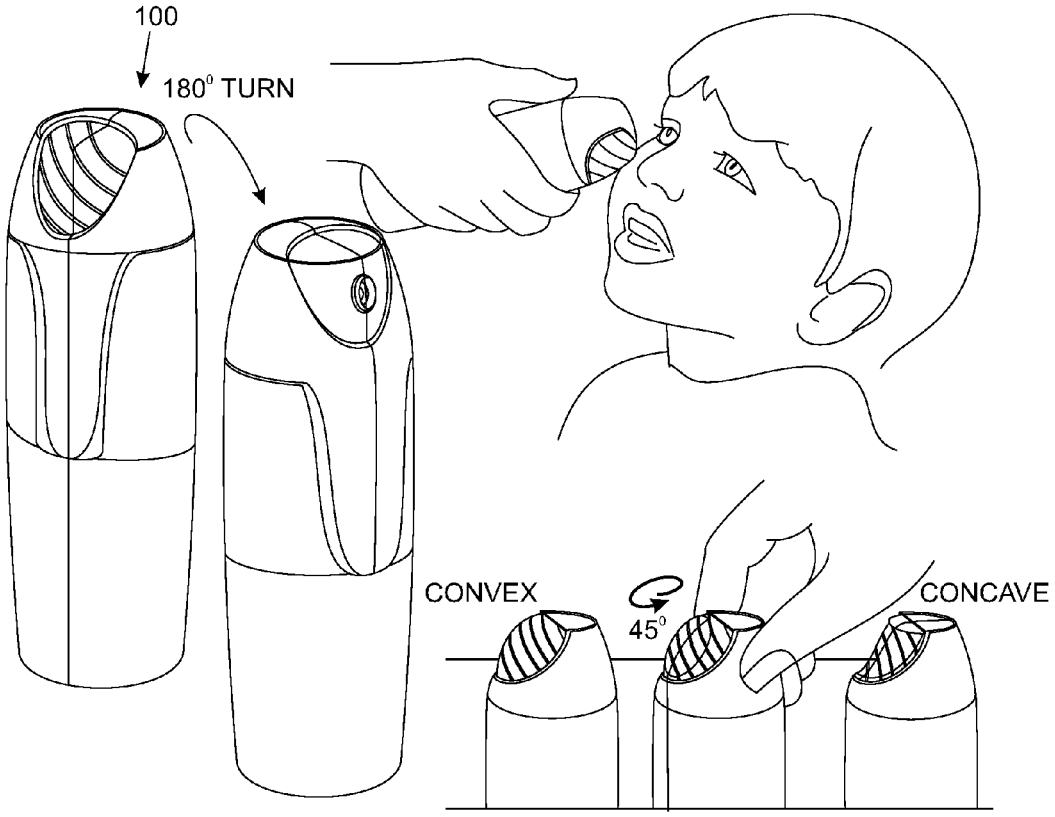
FIG. 11 illustrates an aerosol actuator according to various embodiments of the invention.

According to other embodiments, an applicator may be integrated with the aerosol actuator 100 such that a product may be sprayed into the applicator and then applied using the applicator rather than an aerosol spray. For example, an embodiment illustrated in FIG. 11 may include three positions for the aerosol actuator 100. In a first position, the aerosol actuator 100 may be locked. In a second position, the aerosol actuator 100 may be configured to spray a traditional cone or aerosol spray. In a third position, the aerosol actuator 100 may spray into or onto an applicator pad such that once exposed to the aerosol product, the applicator pad may be used to apply the aerosol product to a surface without using an aerosol delivery system. Thus, a user could use both an aerosol application and a rub-on application with the aerosol actuator 100 and aerosol device.

Figure 12:
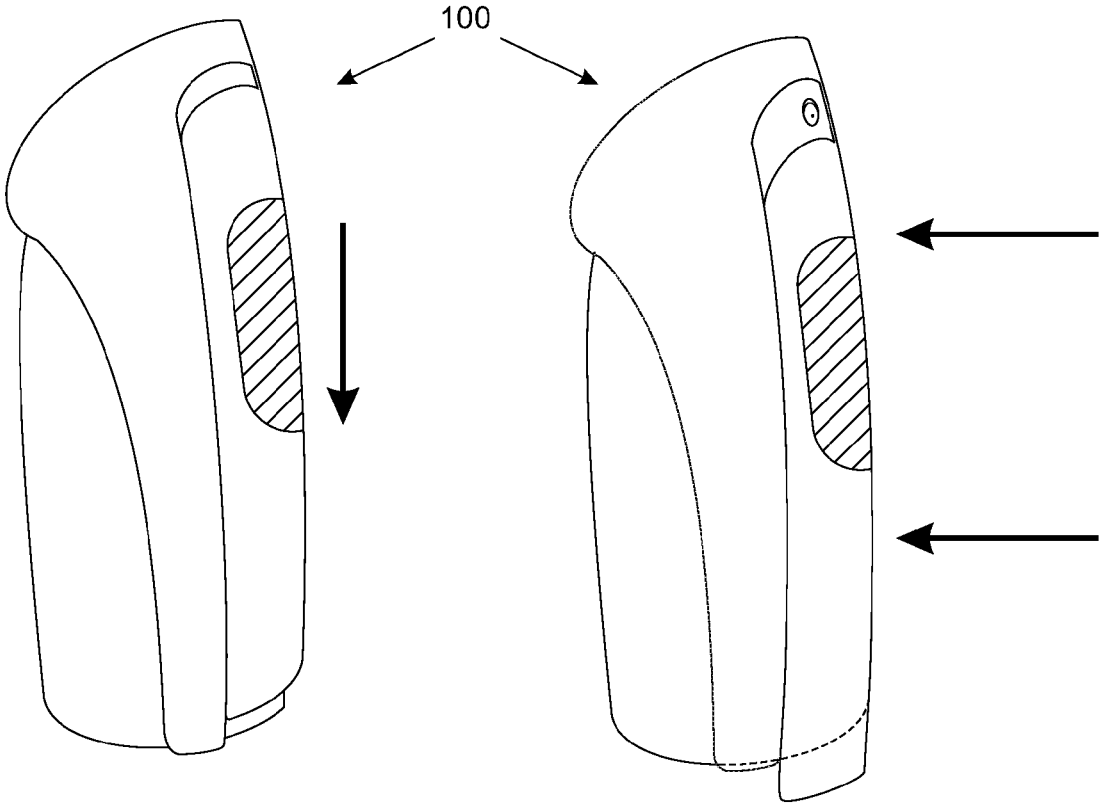
FIG. 12 illustrates an aerosol actuator according to various embodiments of the invention.

In still other embodiments, an aerosol actuator 100 may include a slidable locking and actuation mechanism as illustrated in FIG. 12. In an up position, the slide may lock the aerosol actuator 100 such that the aerosol device cannot be actuated. When moved to an unlocked position, the slide may uncover an orifice and allow the device to be actuated. In addition, actuation may be initiated by pushing anywhere on the slide.

Aerosol actuators according to various embodiments of the invention may be made of any desired material or combination of materials. In some instances, an aerosol actuator may be made of plastic or a resin-based material. In other instances, an aerosol actuator may include metal components. In still other instances, flexible, expandable, or other elastomeric-type materials may be used or integrated into an aerosol actuator design.

According to various embodiments of the invention, any of the aerosol actuators may be attached to, mated with, or otherwise assembled with an aerosol container or can—plastic, metal, or otherwise—having a valve.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. An aerosol system, comprising:

an aerosol container having a top and a bottom and a sidewall extending therebetween; and an aerosol actuator mounted on the top of the aerosol container, the aerosol actuator comprising:

a top actuator configured to actuate the aerosol container;

a handle extending down the sidewall of the aerosol container, the handle being linearly extendable from a locked position to an unlocked position such that a terminal end of the handle extends beyond the bottom of the aerosol container, the handle including an actuator button linearly extendable with the handle which is configured to actuate the aerosol container independent of the top actuator.

2. The aerosol system of claim 1, wherein the top actuator includes an orifice, and wherein the handle and the orifice are vertically aligned.

3. The aerosol system of claim 1, wherein the handle and orifice are located on opposite sides of the aerosol container.

4. The aerosol system of claim 1, wherein the top actuator is rotatable relative to the handle.

5. The aerosol system of claim 1 wherein the actuator button is a tab which extends beyond the bottom of the aerosol container.

6. The aerosol system of claim 1 wherein the handle and actuator button are slidably extendable.

7. The aerosol system of claim 1, wherein the handle and orifice are located on opposite sides of the aerosol container.

8. An aerosol system comprising:

an aerosol container;

an aerosol actuator mounted on the aerosol container, the aerosol actuator including a dispensing orifice; and a hood configured and arranged to be extendable around said dispensing orifice to direct a dispensing spray, wherein the hood is configured to wrap around the aerosol container in a non-hood first configuration and further configured to be deployed over the top of the aerosol actuator to create the hood in a second configuration.

9. The aerosol system of claim 8, wherein the hood is integrated with the aerosol actuator.

10. The aerosol system of claim 9, wherein the hood is elastomeric and is configured to be elastomerically deployed.

11. The aerosol system of claim 8, wherein the hood is integrated with the aerosol container.

12. The aerosol system of claim 11, wherein the hood is elastomeric and is configured to be elastomerically deployed.

13. The aerosol system of claim 8, wherein the hood is elastomeric and is configured to be elastomerically deployed.

* * * * *